US007694798B2

(12) United States Patent
Guindulain Vidondo

(10) Patent No.: US 7,694,798 B2
(45) Date of Patent: Apr. 13, 2010

(54) GROUPING ASSEMBLY OF COIN VALIDATION AND RETURN/PAYMENT MECHANISMS

(75) Inventor: Félix Guindulain Vidondo, Peralta (ES)

(73) Assignee: Jofemar, S.A., Peralta (Navarra) (ES)

( * ) Notice: Subject to any disclaimer, the term of this patent is extended or adjusted under 35 U.S.C. 154(b) by 0 days.

(21) Appl. No.: 11/028,909

(22) Filed: Jan. 4, 2005

(65) Prior Publication Data

US 2005/0191954 A1 Sep. 1, 2005

(30) Foreign Application Priority Data

Jan. 15, 2004 (ES) ..... 200400078
Oct. 29, 2004 (ES) ..... 200402612

(51) Int. Cl.
*G07F 9/10* (2006.01)

(52) U.S. Cl. ..... 194/350

(58) Field of Classification Search ..... 194/350; 453/18, 19

See application file for complete search history.

(56) References Cited

U.S. PATENT DOCUMENTS 1,460,882 A * 7/1923 Betts ..... 194/346
4,629,051 A * 12/1986 Abe ..... 194/261
4,635,661 A * 1/1987 Uematsu et al. ..... 194/217
5,233,343 A * 8/1993 Mazzoni ..... 340/5.33
5,597,061 A * 1/1997 Nishiumi et al. ..... 194/348
5,865,673 A * 2/1999 Geib et al. ..... 453/10
5,899,804 A * 5/1999 Chiba et al. ..... 453/11
6,165,064 A 12/2000 Aurelius et al.
6,386,964 B1 * 5/2002 Thomas ..... 453/17
6,913,131 B2 * 7/2005 Fletcher ..... 194/217
2003/0221933 A1 * 12/2003 Morikawa ..... 194/302

FOREIGN PATENT DOCUMENTS

JP 3218596 9/1991
JP 3-225586 A * 10/1991
JP 3225586 10/1991
NL 9001085 12/1991

* cited by examiner

*Primary Examiner*—Patrick Mackey
*Assistant Examiner*—Mark Beauchaine
(74) *Attorney, Agent, or Firm*—Klauber & Jackson LLC

(57) ABSTRACT

Grouping assembly of coin validation and return/payment mechanisms, in such a way that said compact assembly is useful to be included in automatic vending machines and especially recreative prize machines. In this way the assembly (1) comprises a coin selector (2) with a top duct (3) for conveying the coins from the coin slot of the machine to the selector (2), some deposit tubes (4) of the coins for payment, a remover (5) of the coins from the deposit tubes (4), a coin separator (9) for separating the coins towards two money boxes (10) and (11) and a lifting mechanism (7) for conveying the coins to be returned/paid to the receiving box of the machine connected to a small top duct (8) arranged close to the top duct (3) for conveying the coins to the coin slot of the machine to the selector (2).

11 Claims, 5 Drawing Sheets

GROUPING ASSEMBLY OF COIN VALIDATION AND RETURN/PAYMENT MECHANISMS

OBJECT OF THE MACHINE

As expressed in the title of the present specification, the following invention refers to a grouping assembly of coin validation and return/payment mechanisms. In this way the assembly is useful to be included in automatic vending machines and especially recreative prize machines, in such a way that the assembly groups together a coin selector with a duct for conveying the coins from the coin slot to the selector, some coin deposit tubes, a coin removing mechanism, a pair of money boxes with a separating mechanism and a mechanism for conveying the coins to the receiving box for their return and payment of prizes.

In this way, all the mechanisms necessary for the selection or validation of the coins and for conveyance of the coins to the receiving box form a grouped assembly. This facilitates the assembly thereof at the factory, as well as their assembly in the automatic vending machine and possible subsequent replacement.

Likewise, the assembly may include, at least, one Hopper type coin deposit, with the first object of acting as a loading element, when putting the recreative machine into operation, of the deposit tubes of the coins, which are for payment of prizes.

A second object of the Hopper type coin deposit is being able to act as a reloading element of the deposit tubes of the coins to be used to pay prizes.

Likewise, the grouping assembly may include some sealing means of the inlet duct of the machine of the coins to the validation selector, which will be activated during the reloading of the deposit tubes of the coins to be used to pay prizes, with coins coming from the Hopper type coin deposit.

On the other hand, those coins coming from the Hopper type coin deposit that are rejected by the selector as "invalidated" will be conveyed from the coin distributor to one specific compartment of one of the money boxes.

FIELD OF APPLICATION

The present specification describes a grouping assembly of coin validation and return/payment mechanisms, in such a way that said compact assembly is useful to be included in automatic vending machines and it is especially useful in recreative prize machines.

BACKGROUND OF THE INVENTION

Conventionally, the different mechanisms necessary for coin validation/selection, as well as the return/payment of coins, which are included in automatic machines, both vending machines for dispensing all types of products as well as in recreative prize machines, are comprised of means that should be assembled independently coupling together for the correct operation thereof.

In the way, the assembly operation is made difficult since it is necessary to assemble and couple the different mechanisms in the body of the machine, given that one of the desired requirements is that these mechanisms take up as little space as possible. An attempt is made to optimize the available space.

Besides, it should be taken into account that there are more and more different types and models of automatic coin-operated machines, vending machines of very diverse goods, as well as recreative machines. Therefore, the more personalized they are, the more complex their industrialization is with all the inconveniences represented thereby.

On the other hand, we can indicate that in the operation of putting the recreative prize machines into operation, first of all, it is necessary to load by hand the deposit tubes of the coins to be used for payment. This represents a clear inconvenience, given that a considerable amount of time must be used in said operation due to the large number of coins that should be inserted.

Hence, then the count will begin for a suitable control of the game from the coins inserted, in other words, starting a control of the inserted coins and of the payments made in the game.

Likewise, it can be indicated that in the course of the game a moment may be reached when the number of coins deposited in the different deposit tubes for payment of prizes drops considerably. Conventional machines do not have any means for self-reloading that can avoid a hypothetical and improbable insufficient payment.

DESCRIPTION OF THE INVENTION

The present specification describes a grouping assembly of coin validation and return/payment mechanisms, in such a way that said company assembly is useful to be used in automatic vending machines and especially in recreative prize machines. In this way the assembly comprises a coin selector with a top duct for conveying the coins from the coin slot of the machine to the selector, some deposit tubes of the coins to be used for payments, a remover of the coins from the deposit tubes, a coin separator for separating the coins towards two money boxes and a lifting mechanism for conveying the coins to be returned/paid to the receiving box of the machine connected to a small top duct arranged close to the top duct for conveying the coins from the coin slot of the machine to the selector.

In this way, the coins to be used to pay prizes removed by the remover are guided along an inclined plane to the bottom part of the lifting mechanism for conveying the coins to the receiving box. Hence, the receiving box remains close to the coin slot, in a high position, which is very accessible to the user.

On the other hand, the coins to be collected from their outlet of the selector are conveyed towards the separator through a duct and from said separator, they are directed to one money box or the other. In this way the collected coins will be perfectly divided in order to be able to designate the coins of each one of the money boxes to the corresponding part. This embodiment becomes especially relevant in relation to recreative prize machines whose collection is divided into the part that owns the machine and the owner of the premises where the machine is installed.

Likewise, the coins to be returned, rejected by the selector, from the outlet of the selector are conveyed towards the bottom part of the lifting mechanism for conveying the coins to the receiving box.

On the other hand, the assembly may include, some loading means of the deposit tubes of the coins to be used for payment of prizes. The coin selector has a duct for conveying the coins from the outlet mouth of the Hopper type deposit to the coin selector for validation and conveyance thereof through a distributor, to the deposit tubes of the coins to be used to pay prizes.

On the other hand, the coins coming from the Hopper type deposit not validated as "good" by the selector, are conveyed, through the distributor, to a duct for conveyance to a specific compartment of a money box, given that said coins do not form a part of the general count corresponding to the list of coins inserted to play the game and to pay prizes.

Likewise, when the coin deposit tubes are loaded with coins to be used to pay prizes by means of coins coming from the Hopper type deposit, the inlet channel of the coins into the machine may be sealed to avoid the entry of coins. In this way, a user is prevented from being able to insert coins to play the game without the coins being controlled by the selector upon considering that the coins come from the Hopper type deposit.

In order to complete the description that is going to be made hereinafter, and for the purpose of providing a better understanding of the characteristics of the invention, the present specification is accompanied by a set of drawings, in whose figures the most characteristic details of the invention are represented in an illustrative and non-restrictive manner.

DESCRIPTION OF A PREFERRED EMBODIMENT

Figures 1, 2:
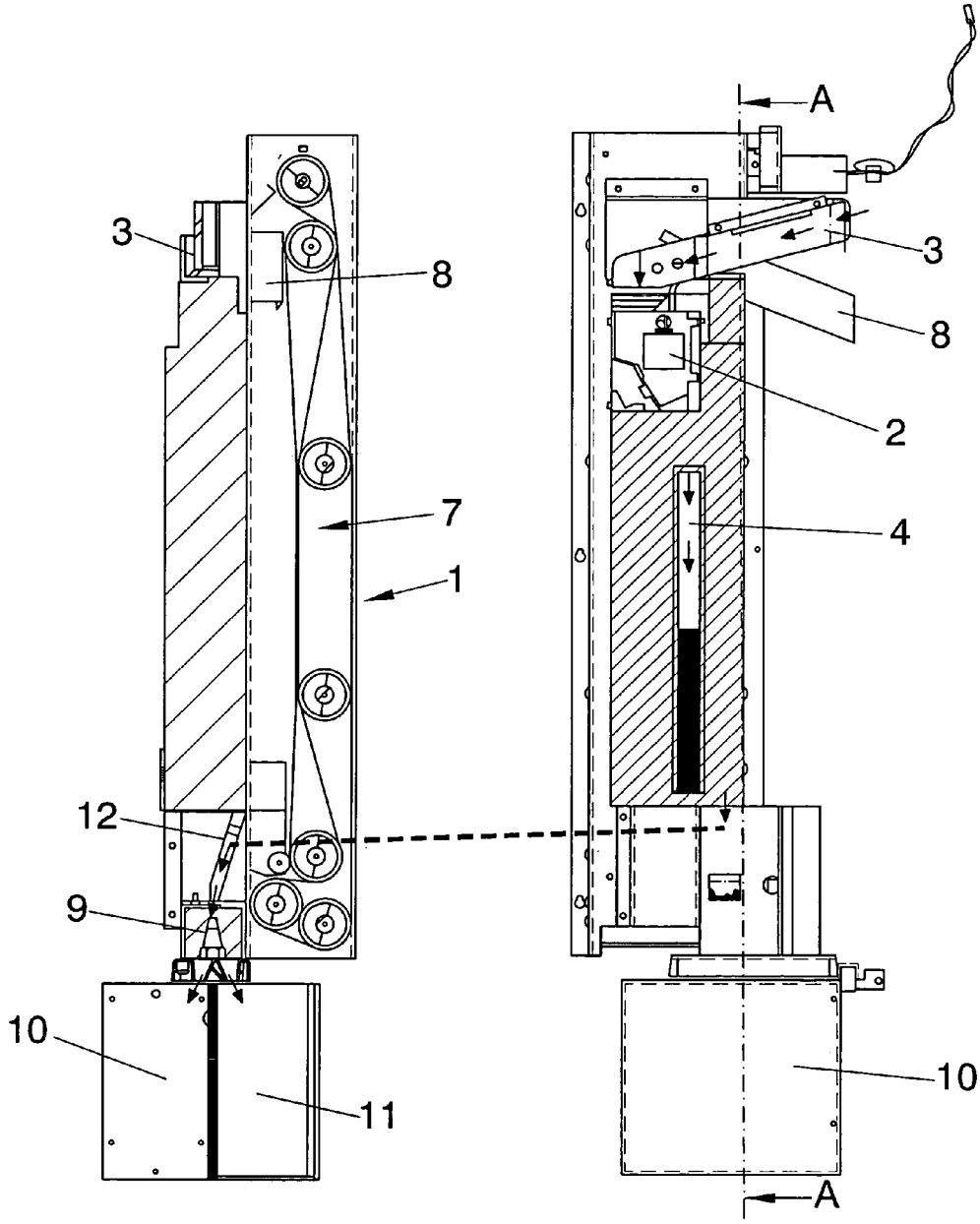
FIG. 1 shows a first side view of the assembly that groups together the coin validation and return/payment mechanisms, wherein one can see the selector with a top duct for access of the coins to be validated, a deposit tube and a bottom money box.
FIG. 2 shows a sectioned view along line A-A of the preceding figure, wherein one can see the duct that directs the coins to the separator that guides them to the corresponding money box, as well as the return/payment mechanism.

In view of the commented figures and in accordance with the numbering used, we can see how in a first embodiment the assembly (1) comprises a coin selector (2) with a top duct (3) for conveying the coins from the coin slot of the machine to the selector (2), in such a way that certain coins validated as "good" are conveyed to some deposit tubes (4) of the coins to be used for payment.

There is also a remover (5) of the coins from the deposit tubes (4) under the different deposit tubes (4) of the coins, in such a way that the coins removed along an inclined plane (6) are guided to a lifting mechanism (7) of the coins. The lifting mechanism conveys them to the receiving box, to which they are diverted by a small top duct (8) close to the coin inlet duct (3).

In this way, the receiving box of the coins on the part of the user, to which the small duct (8) discharges into is at a height similar to that of the coin slot. Hence the receiving box is very accessible to the user.

Likewise, the grouping assembly of the coin validation and return/payment mechanisms has a separator (9) of coins, that are to be definitively deposited, towards two money boxes (10) and (11). The coins have access to the separator (9) through a duct (12), in such a way that this separation of coins to be collected in two different money boxes, to be included in recreative prize machines, has the big advantage that the coins can be perfectly separated for their division.

Hence, this embodiment permits the collection obtained to be separated into two money boxes, in such a way that the collection of one of the money boxes will correspond to the owner of the machine and the collection from the other money box will correspond to the owner of the premises where the machine is installed.

Besides, in accordance with what is programmed, the percentage designated to each one of the money boxes will be carried out automatically, which represents an important advantage.

The coins that should be collected directly, once they have been validated by the selector (2), from their corresponding outlet of the selector (2) are conveyed through a duct (12) towards the separator (9) that directs them to one money box or the other. The duct (12) is connected to the duct that conveys the coins from the corresponding outlet of the selector (2).

On the other hand, the coins to be returned, rejected by the selector (2), from the respective outlet of the selector (2) are conveyed towards the bottom part of the lifting mechanism (7) for conveying the coins to the receiving box.

Making reference to the attached designs we can see in FIGS. 1 and 2 of the drawings how some coins, used to pay prizes, are conveyed from the selector to the different deposit tubes (4), whereas other coins are conveyed towards the duct (12) that will suitably direct them to the separator (9) for the definitive deposit thereof in the collection money box (10) or (11).

Figure 4:
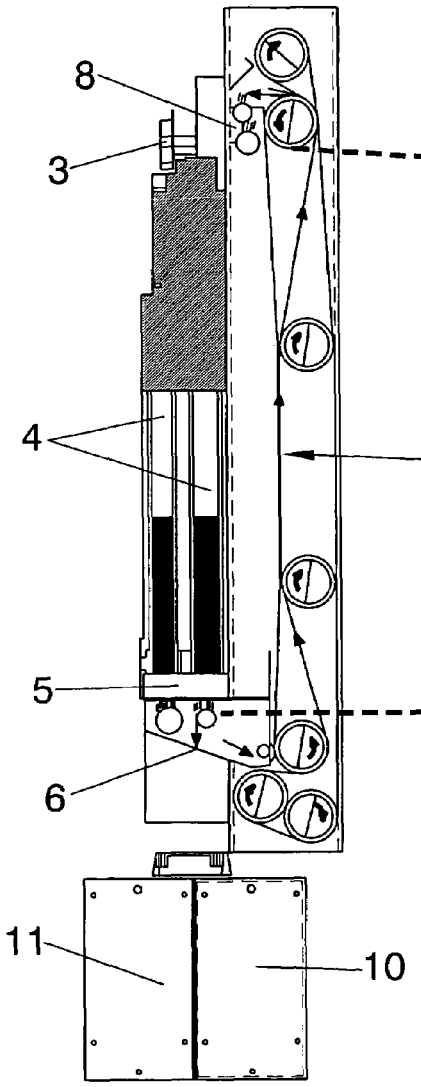
FIG. 4 shows a sectioned view along line B-B of the preceding figure, wherein one can see some coin deposit tubes. Some coins for a payment with the return/payment mechanism and the pair of money boxes have been represented.
Figure 3:
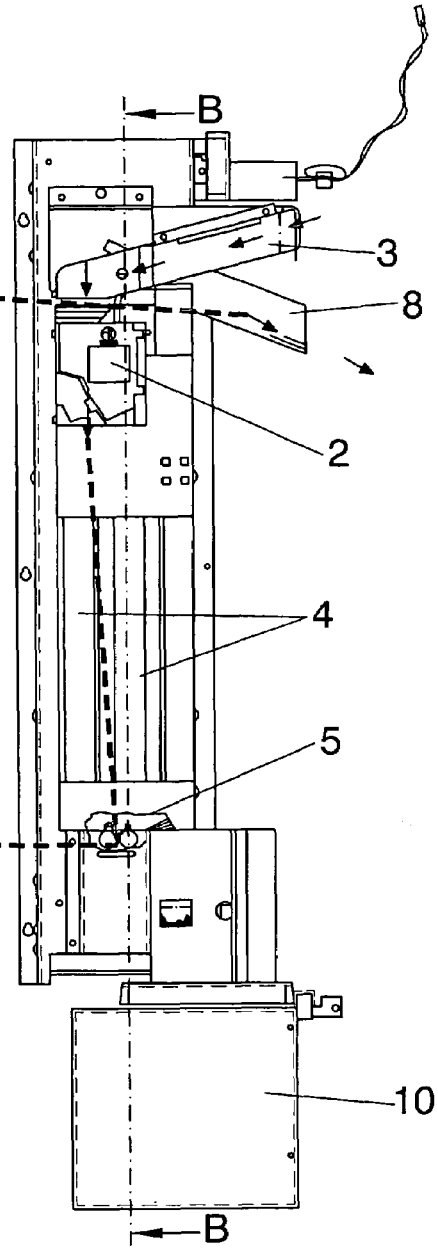
FIG. 3 shows a second side view of the assembly that groups together the coin validation and return/payment mechanisms, wherein one can see the selector with the top duct for access of the coins to be validated, some deposit tubes and a bottom money box. The path followed by a coin that is going to be returned has been represented.
Figure 6:
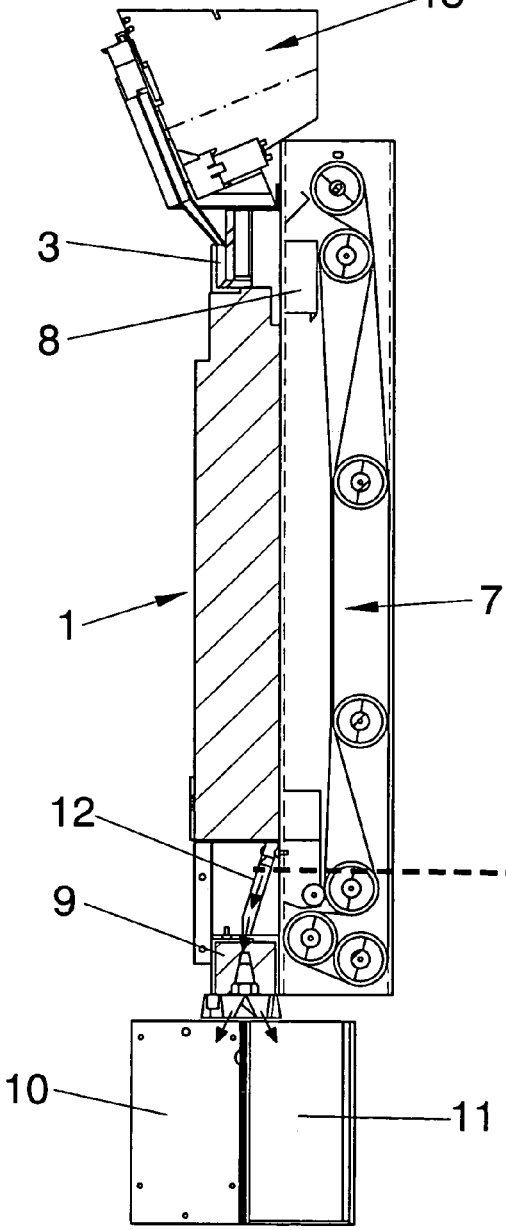
FIG. 6 shows a sectioned view along line C-C of the preceding figure, wherein one can see the duct that directs the coins to the separator that guides them to the corresponding money box, as well as the return/payment mechanism and a Hopper type coin deposit in the part above the selector.
Figure 5:
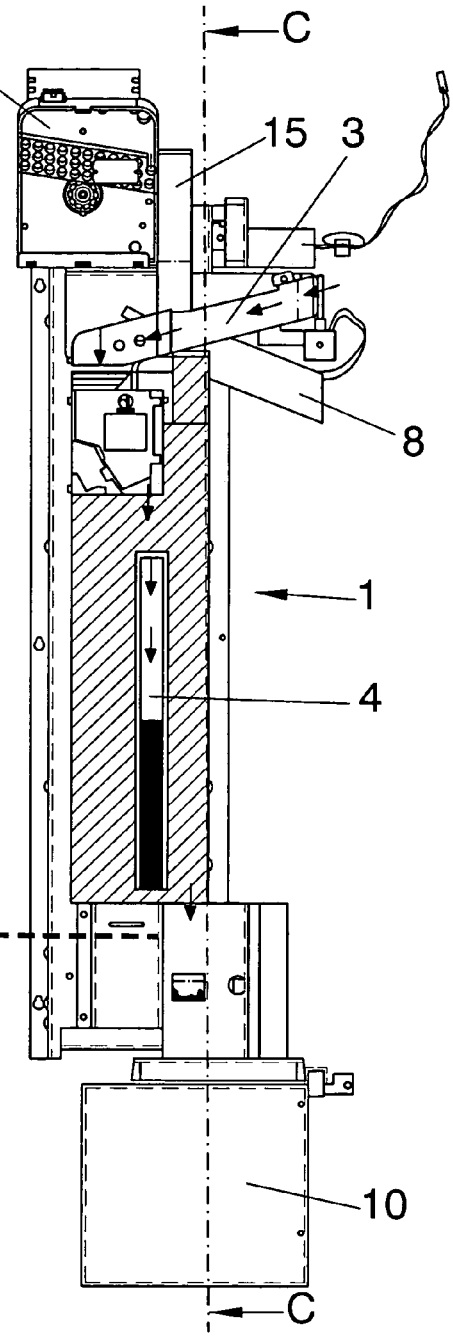
FIG. 5 shows a first side view of the assembly that groups together the coin validation and return/payment mechanism, wherein one can see the selector with the top duct for access to the coins to be validated, a deposit tube and a bottom money box, as well as a Hopper type coin deposit in the part above the selector.
Figures 7, 8:
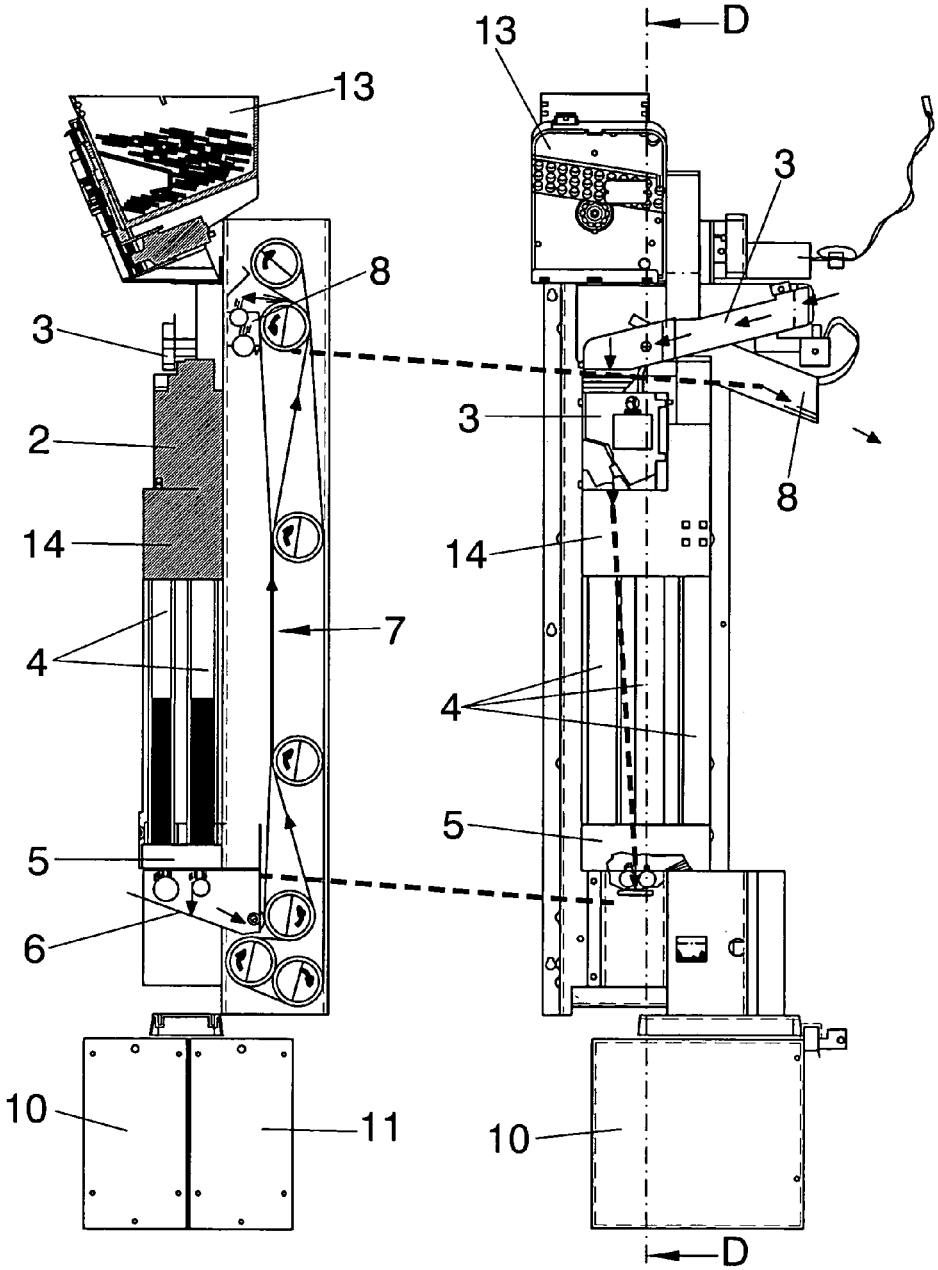
FIG. 7 shows a second side view of the assembly that groups together the coin validation and return/payment mechanisms, wherein one can see the selector with the top duct for access to the coins to be validated, some deposit tubes and a bottom money box. The path followed by a coin that is going to be returned, as well as a Hopper type coin deposit in the part above the selector have been represented.
FIG. 8 shows a sectioned view along line D-D of the preceding figure, wherein one can see some coin deposit tubes. Some coins for a payment by the return/payment mechanism and the pair of money boxes, as well as a Hopper type coin deposit in the part above the selector have been represented.

In FIGS. 3 and 4 of the drawings we can see how, on the one hand, the coins removed from the different deposit tubes along the inclined plane (6) are conveyed to the lifting mechanism (7) for conveying the coins to the receiving box. On the other hand, the rejected coins (broken line) come out of the selector (2) and are conveyed directly to the bottom part of the lifting mechanism for conveying the coins to the receiving box.

In a second embodiment of the invention, as an improvement of that which has been described, the assembly (1) is capable of including a Hopper type coin deposit (13) in the grouping assembly (1) of coin validation and return/payment mechanisms maintaining a compact assembly (1).

Just as it has been indicated, the assembly (1) groups together a coin selector (2) with a top duct (3) for entry of the coins that are conveyed from the coin slot to the machine to the selector (2), in such a way that certain coins validated as "good" are conveyed to the deposit tubes (4) of the coins used for payment.

The coins are conveyed to the different deposit tubes (4) by means of the corresponding conventional distributor (14).

Moreover, there is a remover (5) of the coins from the deposit tubes (4) under the different deposit tubes (4) of the coins to be used to pay prizes, in such a way that the coins removed along an inclined plane (6) are guided to a lifting mechanism (7) for conveying the coins to the receiving box. The coins are diverted by a small top duct (8) close to the inlet duct (3) of the coins.

Likewise, as we have indicated, the grouping assembly of the validation and return/payment of coins mechanisms have a separator (9) of coins to be definitively deposited, towards two money boxes (10) and (11), that directs the coins to one money box or the other. The coins have access to the separator (9) through a duct (12).

The inclusion of a Hopper type coin deposit (1), in the first place, facilitates the initial loading of the machine, in other words, of the different deposit tubes (4) of the coins used to pay prizes, given that this allows a large amount and diversity of coins to be inserted therein. In this way, the coins are automatically conveyed to the selector and from the selector through the distributor (14), to the different deposit tubes (4) of the coins used to pay prizes.

In this way, having to load the coins by hand before putting the machine into operation is avoided, so that, as of said load, the control of the machine in playing the game begins since said initial load is required.

Likewise, secondly, the inclusion of a Hopper type coin deposit (13) makes it possible to reload the different deposit tubes (4) with coins used for payment. Said circumstance could arise in exceptional cases wherein the deposit tubes (4) can have a reduced number of coins.

In this way, the recreative machine could be programmed in such a way that in the presence of an order of the control and operating system, that detects a reduced number of coins, a reloading of coins from the Hopper type coin deposit (13) is produced.

Figure 9:
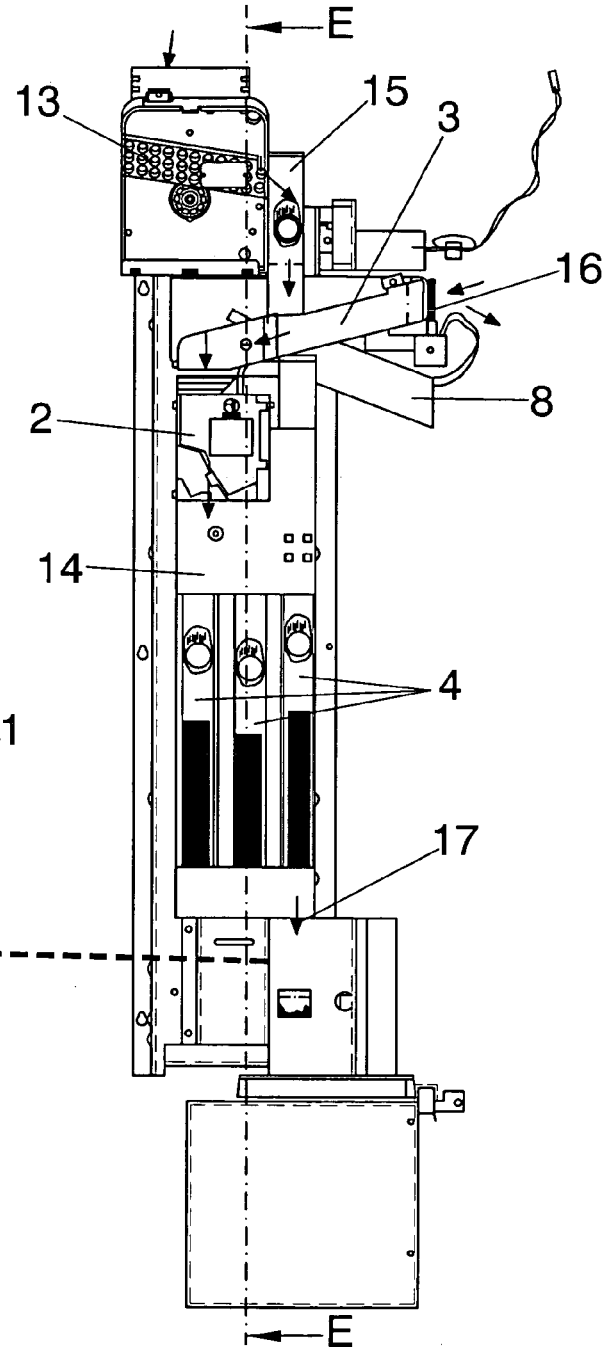
FIG. 9 shows a side view of the assembly that groups together the coin validation and return/payment mechanisms with a Hopper type coin deposit above the selector, wherein one can see the path followed by the coins from said Hopper type deposit to the deposit tubes of the coins used for payments.

Hence, as one can see in FIG. 9 of the drawings, we see how in the loading operation of the deposit tubes (4) of the coins used to pay prizes, the coins are conveyed from the outlet mouth of the Hopper type deposit (13) up to the selector (2) through a duct (15) that discharges into the inlet channel (3) of the coins for guiding them to the selector and from the selector to the different deposit tubes through the distributor (14).

On the other hand, the coins coming from the Hopper type deposit (13) are guided, along the corresponding channel, towards the duct (12) for access to the separator (9) that conveys them to a specific compartment in each one of the money boxes (10 or 11).

Figure 10:
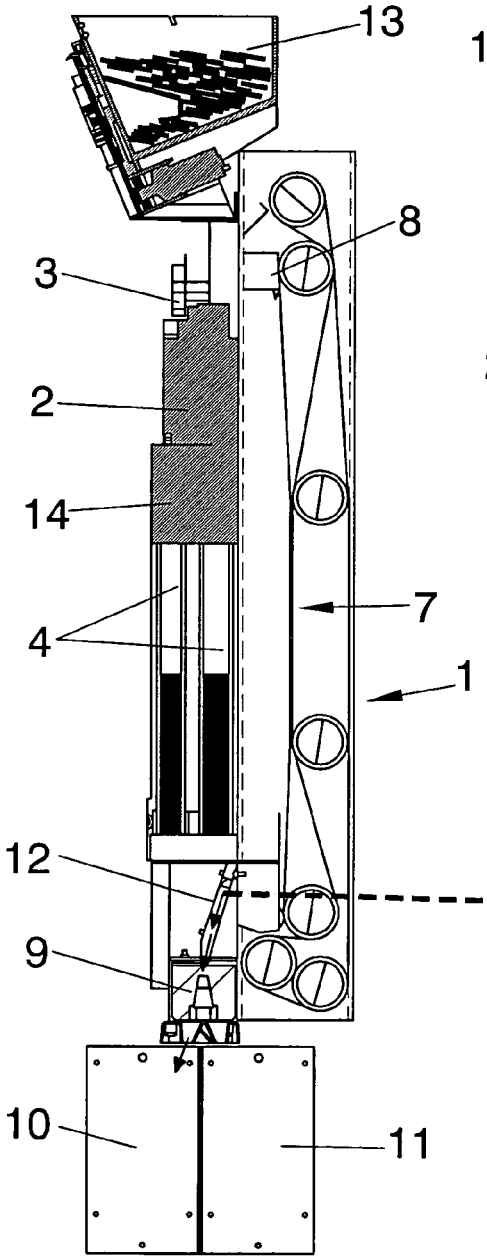
FIG. 10 shows a sectioned view along line E-E of the preceding figure, wherein one can see the duct that directs the coins coming from the Hopper type deposit and not validated as "good" by the selector towards a compartment of one of the money boxes, as well as a means for sealing the inlet channel of the coins into the machine.

FIGS. 9 and 10 of the drawings show how the coins coming from the Hopper type deposit (13) not validated as "good" by the selector (2) are conveyed through a channel relative to the arrow (17) continuing towards the duct (12) and from the duct to the distributor (9) for conveyance of the coins to the specific compartment of the money box (10) or (11).

Regarding this, we can indicate that, normally, the coins inserted in the Hopper type deposit (13), in principle, are all validated given that they have not been inserted by users of the machine. They have rather been inserted by the operator of the machine, even when the same should also be validated although it is done by the control of a smaller number of parameters.

On the other hand, during the reloading of the deposit tubes (4) of the coins used to pay prizes, with coins coming from the Hopper type deposit (13), a means (16) for sealing the inlet channel (3) of the coins into the machine so that said coins are not considered by the selector (2) as coins coming from the Hopper type deposit (13), can be activated.

This is so given that the coins inserted in the Hopper type deposit (13) should not be counted by the control system as they are not part of the game being played on the recreative machine.

Hence, by means of the described assembly it is possible to assemble the assembly outside the structure of the machine in which it is going to be included. Thus this facilitates the assembly operation since it is much more convenient, and, consequently, more rapid and more economical, in such a way that once the assembly has been assembled, it will be entirely assembled on the body of the machine. Hence, the subsequent operations are likewise made easier.

The invention claimed is:

1. Grouping assembly of coin validation, and return and payment mechanisms, for automatic vending machines, said grouping assembly of coin validation and return and payment mechanisms comprising a coin selector;

a top duct connected by one of its ends to an inlet coin slot of the machine and by the other end thereof to the coin selector, said top duct for conveying coins from the inlet coin slot of the machine to the coin selector;

deposit tubes of coins used for payment;

a distributor connected by one of its ends to the coin selector and by the other end thereof to the deposit tubes, said distributor for distributing coins from the coin selector to the deposit tubes;

a remover of coins from the deposit tubes;

a separator of coins connected to the coin selector, said separator ending in two money boxes, so that the coins inserted through the inlet coin slot to be collected move directly from the coin selector to said separator without being stored previously in the deposit tubes, the separator separating a predetermined percentage of the received money in each of the money boxes;

a lifting mechanism for conveying the coins to be returned and the coins to be paid to a receiving box of the machine, said lifting mechanism connected to the remover by means of an inclined plane, and connected to the receiving box by means of a second top duct arranged close to the previous top duct;

the coin selector, the top duct, the inlet coin slot, the deposit tubes of coins, the distributor, the remover of coins, the separator of coins, the money boxes, the lifting mechanism, the inclined plane and the second top duct being grouped in an integral unit forming a grouped assembly;

wherein said assembly comprises additionally means for loading the deposit tubes of the coins used to pay prizes, said means being defined by, at least one coin deposit comprising a hopper with a rotating body at its internal base, said coin deposit assembled on the coin selector with a duct for conveying the coins from an outlet mouth of the coin deposit to the coin selector for validation thereof;

a specific compartment inside each one of the money boxes intended to receive invalid coins.

2. Grouping assembly of coin validation, and return and payment mechanisms, according to claim 1, wherein said automatic vending machines are recreative prize machines.

3. Grouping assembly of coin validation, and return and payment mechanisms, according to claim 1, wherein the coins used for the payment of prizes removed by the remover are guided along the inclined plane to the bottom part of the lifting mechanism for conveying coins to the receiving box.

4. Grouping assembly of coin validation, and return and payment mechanisms, according to claim 2, wherein the coins used for the payment of prizes removed by the remover are guided along the inclined plane to the bottom part of the lifting mechanism for conveying coins to the receiving box.

5. Grouping assembly of coin validation, and return and payment mechanisms, according to claim 1, wherein the coins to be collected from an outlet of the selector are conveyed through a duct towards the separator that directs them to one money box or the other one.

6. Grouping assembly of coin validation, and return and payment mechanisms, according to claim 2, wherein the coins to be collected from an outlet of the selector are conveyed through a duct towards the separator that directs them to one money box or the other one.

7. Grouping assembly of coin validation, and return and payment mechanisms, according to claim 1, wherein the coins rejected by the selector are conveyed from the outlet of said selector towards the bottom part of the lifting mechanism for conveyance of the coins to the receiving box in order to be returned.

8. Grouping assembly of coin validation, and return and payment mechanisms, according to claim 2, wherein the coins rejected by the selector are conveyed from the outlet of said selector towards the bottom part of the lifting mechanism for conveyance of the coins to the receiving box in order to be returned.

9. Grouping assembly of coin validation, and return and payment mechanisms, according to claim 1, wherein the coins coming from the coin deposit not validated as good by the selector are conveyed, through the distributor, to a conveyance duct, through the separator to the specific compartment of a money box.

10. Grouping assembly of coin validation, and return and payment mechanisms, according to claim 1, wherein during the loading of the deposit tubes of the coins used to pay prizes by means of coins coming from the coin deposit, the top duct connecting the inlet coin slot and the coin selector can be sealed by a sealing means in order to avoid coins from entering into the recreative machine.

11. Grouping assembly of coin validation, and return and payment mechanisms, according to claim 2, wherein during the loading of the deposit tubes of the coins used to pay prizes by means of coins coming from the coin deposit, the top duct connecting the inlet coin slot and the coin selector can be sealed by a sealing means in order to avoid coins from entering into the recreative machine.

* * * * *